US011585529B2

(12) United States Patent
Theis et al.

(10) Patent No.: US 11,585,529 B2
(45) Date of Patent: Feb. 21, 2023

(54) RADIANT WALL BURNER

(71) Applicant: John Zink Company, LLC, Tulsa, OK (US)

(72) Inventors: Gilles Theis, Dudelange (LU); Valeriy Smirnov, Tulsa, OK (US); I-Ping Chung, Tulsa, OK (US); Ahmed Kadi, Dudelange (LU); Hadj Ali Gueniche, Dudelange (LU)

(73) Assignee: John Zink Company, LLC, Tulsa, OK (US)

( * ) Notice: Subject to any disclaimer, the term of this patent is extended or adjusted under 35 U.S.C. 154(b) by 135 days.

(21) Appl. No.: 16/762,958

(22) PCT Filed: Nov. 16, 2018

(86) PCT No.: PCT/IB2018/059068

§ 371 (c)(1),
(2) Date: May 11, 2020

(87) PCT Pub. No.: WO2019/097483

PCT Pub. Date: May 23, 2019

(65) Prior Publication Data

US 2020/0400308 A1 Dec. 24, 2020

Related U.S. Application Data

(60) Provisional application No. 62/588,466, filed on Nov. 20, 2017.

(51) Int. Cl.

| | |
|---|---|
| ***F23D 14/12*** | (2006.01) |
| ***F23D 14/22*** | (2006.01) |
| ***F23D 14/84*** | (2006.01) |

(52) U.S. Cl.

CPC ..... *F23D 14/126* (2021.05); *F23D 14/22* (2013.01); *F23D 14/84* (2013.01); *F23D 2900/00011* (2013.01)

(58) Field of Classification Search

CPC ..... F23D 14/02; F23D 14/12; F23D 14/22; F23D 14/62; F23D 14/84; F23D 2900/14001

See application file for complete search history.

(56) References Cited

U.S. PATENT DOCUMENTS

| | | | | |
|---|---|---|---|---|
| 2,112,888 A * | 4/1938 | Greenawalt | F23D 11/08 431/182 |
| 3,154,134 A * | 10/1964 | Fredericks | F23D 14/22 239/431 |
| 4,595,355 A * | 6/1986 | Garrelfs | F23D 11/001 431/183 |
| 5,110,285 A * | 5/1992 | Snyder | F23D 14/22 239/590.5 |

(Continued)

FOREIGN PATENT DOCUMENTS

| | | |
|---|---|---|
| CA | 2255549 A1 | 6/1999 |
| CA | 2348335 A1 | 2/2002 |

(Continued)

OTHER PUBLICATIONS

Machine Translation of WO 2012048954 A1 (Year: 2012).*

(Continued)

*Primary Examiner* — Jorge A Pereiro
*Assistant Examiner* — Nikhil P Mashruwala

(57) ABSTRACT

A burner and a method utilize a burner tile with an outer surface extending along the furnace wall and an inner surface defining a passageway. A fuel duct extends at least partially through the passageway and discharges fuel onto a burner head. The burner head forms a coanda-curved surface, wherein the fuel is directed onto the coanda-curved surface such that the fuel flows along the coanda-curved surface to the outer surface of the burner tile. There is an air channel defined by an outside edge of the coanda-curved surface and in fluid flow communication with the passageway such that air flows from the passageway through the channel to mix with the fuel so as to produce the combustible mixture.

11 Claims, 8 Drawing Sheets

(56) References Cited

U.S. PATENT DOCUMENTS

| | | | | |
|---|---|---|---|---|
| 5,658,141 | A | 8/1997 | Larquet | |
| 5,863,192 | A * | 1/1999 | Motegi | F23C 9/006 239/431 |
| 7,175,423 | B1 | 2/2007 | Pisano | |
| 9,134,024 | B2 | 9/2015 | Platvoet | |
| 9,423,127 | B2 | 8/2016 | Platvoet | |
| 2012/0231400 | A1 | 9/2012 | Moxham | |
| 2014/0102440 | A1* | 4/2014 | Martin | F23D 14/84 431/346 |
| 2015/0044618 | A1* | 2/2015 | Martin | F23D 14/125 431/189 |
| 2017/0268771 | A1 | 9/2017 | Maley et al. | |
| 2020/0191385 | A1* | 6/2020 | Carroll | F23D 14/64 |

FOREIGN PATENT DOCUMENTS

| | | | | |
|---|---|---|---|---|
| CN | 1059593 | A | 3/1992 | |
| CN | 1100790 | A | 3/1995 | |
| CN | 1506609 | A | 6/2004 | |
| CN | 101135442 | A | 3/2008 | |
| CN | 104969003 | A | 10/2015 | |
| CN | 105444169 | A | 3/2016 | |
| EP | 0645583 | A1 * | 3/1995 | F23D 14/24 |
| EP | 0645583 | A1 | 3/1995 | |
| EP | 2812633 | A2 | 12/2014 | |
| ES | 160580 | U | 11/1970 | |
| GB | 1299133 | A | 12/1972 | |
| RU | 2187752 | C2 | 8/2002 | |
| UA | 96688 | C2 | 11/2011 | |
| WO | WO-2012048954 | A1 * | 4/2012 | F23C 7/002 |

OTHER PUBLICATIONS

Machine Translation of EP 0645583 A1 (Year: 1995).*

International Search Report and Written Opinion received for PCT patent application No. PCT/IB2018/059068, dated Feb. 11, 2019, 13 pages.

* cited by examiner

RADIANT WALL BURNER

CROSS-REFERENCE TO RELATED APPLICATIONS

This application is a filing under 35 U.S.C. 371 as the National Phase of International Patent Application No. PCT/IB2018/059068, filed on Nov. 16, 2018, which claims the benefit of and priority to U.S. Provisional Application No. 62/588,466, filed on Nov. 20, 2017, both of which are incorporated herein by reference in their entirety.

FIELD

This disclosure relates to the field of industrial burners and in particular to radiant wall burners, which operate to heat the surrounding portions of a wall of a furnace or the like.

BACKGROUND

Radiant wall burners are used in industrial applications to heat the surrounding portions of a wall of a furnace or the like. For example, radiant wall burners are used in the petrochemical industry in processes such as hydrogen reforming, ammonia reforming, ethylene cracking and ethylene dichloride (EDC) cracking. Most of the burners currently used for these applications consist of premix burners, characterized by fuel gas and combustion air mixed together in a venturi before entering the furnace and combusting. Further, the burners are commonly used with various fuel gases, such as natural gas, liquefied petroleum gas (LPG), refinery gas and mixtures thereof. The fuel gases may contain varying amounts of hydrogen depending on their mixture components.

The afore described premix concept works fine with fuel gases having low to medium flame speeds, such as those containing low to medium amounts of hydrogen in the fuel gas. However, there can be problems in using the premix concept with fuel gases having relatively high flame speeds. For example, higher amounts of hydrogen increase considerably the flame speed of the premix mixture exiting the burner nozzle, with increased risk of flame flashback, e.g. flame entering the burner, damaging or destroying the same. As a minimum, such flame flashbacks reduce the performance of the plant, and if they result in damage to the burner, the cost of repair or replacement is considerable, especially if the plant has to be shut down. With multiple burners in a furnace, typically hundreds of burners, the risk of flashback in at least one of the burners can be considerable.

Additionally, a design for a burner to prevent flashback must also meet other design specifications such as $NO_X$ emissions. Reduction and/or abatement of $NO_x$ in radiant burners is a desirable aim. Accordingly, the industry has need of burners that avoid flashback and that still allow for decreased overall $NO_X$ generation and emissions.

BRIEF SUMMARY OF THE INVENTION

Embodiments of the present invention provide a novel system and method for preventing flashbacks in a system with low overall $NO_X$ generation and emission. Some exemplary embodiments are described below.

In one set of embodiments, a burner for burning a combustible mixture in a furnace to produce a flame is described. The combustible mixture comprises fuel and air.

The burner comprises a burner tile and a burner head. The burner tile has an outer surface and an inner surface. The outer surface extends along a furnace wall of the furnace. The inner surface defines a passageway extending normal to the outer surface, wherein the passageway terminates in a distal end at the outer surface. A fuel duct extends at least partially through the passageway and terminates in at least one fuel nozzle.

The burner head is positioned at the distal end of the passageway and forms a coanda-curved surface. The nozzle directs fuel onto the coanda-curved surface such that the fuel flows along the coanda-curved surface to the outer surface of the burner tile. An air channel is defined by an outside edge of the coanda-curved surface. The air channel is in fluid flow communication with the passageway such that air flows from the passageway through the channel to mix with the fuel so as to produce the combustible mixture and such that the flame is produced at the outer surface of the burner tile with the flame spreading along the furnace wall surrounding the burner tile.

Generally, the flame is produced such that flame anchoring is outside the coanda-curved surface on the burner head. In some embodiments, all the fuel for the combustible mixture is introduced through the fuel nozzle. In the aforementioned embodiments, a plurality of stabilizers can extend from the outside edge of the coanda-curved surface into the air channel.

In some of the above embodiments, the coanda-curved surface further includes a plurality of air ports in fluid flow communication with the passageway such that fuel flowing along the coanda-curved surfaces mixes with air from the air ports prior to the fuel mixing with air passing through the air channel. The mixing of fuel with air from the air ports produces a fuel rich premix. The mixing of air from the air channel with the fuel rich premix produces the combustible mixture. In the above embodiments, the fuel duct can extend through the burner head so that the fuel nozzle is positioned outside the passageway and within the furnace, and the nozzle can be configured to direct fuel radially outward and onto the coanda-curved surface. Also in the above embodiments, the fuel rich premix can mix with air passing through the air channel such that the flame is produced with flame anchoring occurring outside the coanda-curved surface.

The above embodiments can include a plurality of stabilizers extending from the outside edge of the coanda-curved surface into the air channel. Further, in some of the above embodiments, all the fuel for the combustible mixture is introduced through the fuel nozzle.

In one set of the above embodiments, the burner head caps the distal end of the passageway with the coanda-curved surface being a dome-like surface over the distal end of the passageway. The fuel duct extends through the burner head so that the fuel nozzle is positioned outside the passageway and within the furnace. The nozzle is configured to direct fuel radially outward and onto the coanda-curved surface.

In another set of the above embodiments, a first portion of the coanda-curved surface is depressed into a part of the passageway so as to define an annular portion of the passageway around the first portion of the coanda-curved surface, and the first portion is configured to form an inner divergent conical surface. The fuel nozzle can be positioned within the first portion and can be configured to direct the fuel tangentially so as to move cyclonically along the first portion.

Additionally, a second portion of the coanda-curved surface can be configured as a convex-coanda surface curving out from the air passageway and towards the outer surface of the burner tile. The second portion can extend from the first portion of the coanda-curved surface to the outer surface of the tile. The fuel, after moving cyclonically along the first portion, spreads radially outward on the second portion and onto the outer surface of the burner tile.

In this set of embodiments, a secondary fuel nozzle can be positioned outside the passageway and within the furnace. The secondary fuel nozzle can be configured to direct fuel generally radially outward.

In another set of embodiments, there is disclosed a method of operating a burner for burning a combustible mixture in a furnace to produce a flame. The combustible mixture comprises fuel and air, and the furnace has a furnace wall. The method can comprise the steps of

- introducing the fuel onto a coanda-curved surface such that the fuel flows along the coanda-curved surface to an outer surface of a burner tile;
- introducing air through an air channel defined by an outside edge of the coanda-curved surface so that the air mixes with the fuel so as to produce a combustible mixture;
- igniting the combustible mixture to produce a flame such the flame is produced at the outside edge of the coanda-curved surface and flame spreads along the furnace wall surrounding the burner tile with flame anchoring occurring outside the coanda-curved surface.

The method can include turbulizing the air passing through the air channel with stabilizers. In some embodiments, all the fuel for the combustible mixture is introduced onto the coanda-curved surface.

In some embodiments, the method can further comprise the step of introducing a pre-mix air through a plurality of air ports in the coanda-curved surface such that fuel flowing along the coanda-curved surfaces mixes with the pre-mix air from the air ports prior to the fuel mixing with air passing through the air channel. The mixing of fuel with air from the air ports produces a fuel rich premix with the fuel rich premix later mixing with the air passing through the channel to produce the combustible mixture.

In some embodiments, the fuel is directed radially outward and onto the coanda-curved surface. In other embodiments, fuel is introduced below and onto the coanda-curved surface. The fuel can be introduced through one or multiple gas nozzles.

In one set of embodiments of the method, a first portion of the coanda-curved surface is depressed into a part of an air passageway so as to define an annular portion of the air passageway, and the first portion is configured to form an inner divergent conical surface. The fuel nozzle is positioned within the first portion and is configured to direct a first portion of the fuel tangentially so as to move cyclonically along the inner divergent conical surface.

Additionally, in this set of embodiments, a second portion of the coanda-curved surface can be configured as a convex-coanda surface curving out from the air passageway and towards the outer surface of the burner tile with the second portion extending from the first portion of the coanda-curved surface to the outer surface of the burner tile. In such embodiments, the first portion of the fuel, after moving cyclonically along the inner divergent conical surface, spreads radially outward on the second portion of the coanda-curved surface and onto the outer surface of the burner tile. Air from the annular portion of the air passageway is introduced into the air channel.

Also in this set of embodiments, a second portion of the fuel can be directed generally radially outward from a secondary fuel nozzle which is located further into the furnace chamber than the primary nozzle.

BRIEF DESCRIPTION OF THE DRAWINGS

FIG. 6 is a sectional side view of the burner of FIG. 5.

DESCRIPTION

Figure 1:
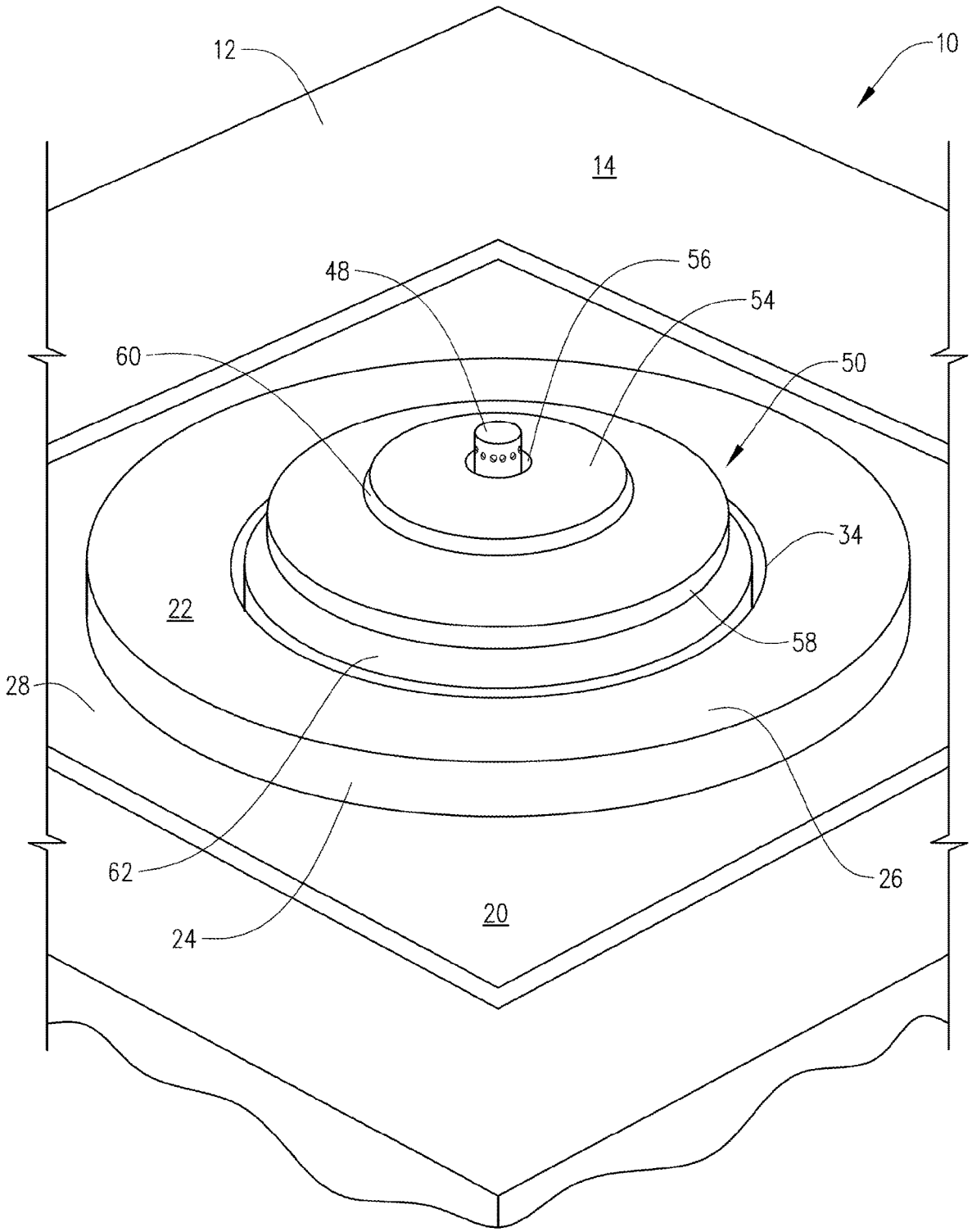
FIG. 1 is a schematic perspective view of a burner in accordance with one embodiment.

The present disclosure may be understood more readily by reference to the following description. In addition, numerous specific details are set forth in order to provide a thorough understanding of the embodiments described herein. However, those of ordinary skill in the art will understand that the embodiments described herein can be practiced without these specific details. In other instances, methods, procedures and components have not been described in detail so as not to obscure the related relevant feature being described. Additionally, the description is not to be considered as limiting the scope of the embodiments described herein.

The features of the current burner and methods related thereto will be described with reference to the drawings, wherein like reference numbers are used herein to designate like elements throughout the various views, various embodiments are illustrated and described. The figures are not necessarily drawn to scale, and in some instances the drawings have been exaggerated and/or simplified in places for illustrative purposes only. Where components of relatively well-known designs are employed, their structure and operation will not be described in detail. One of ordinary skill in the art will appreciate the many possible applications and variations of the present invention based on the following description.

A radiant wall burner configuration of this invention utilizes a design to mix fuel with combustion air and inert furnace gases while directing them along the furnace wall in which the burner is mounted. More specifically, the design uses a coanda-curved surface to direct the fuel along a burner tile surface and the furnace wall. The inert furnace gases are mixed into the fuel as it travels across the coanda-curved surface. Combustion air is introduced into the fuel as the fuel (mixed with any inert furnace gases) moves from the coanda-curved surface to the surface of the burner tile. In some embodiments, all the fuel is introduced to move across the coanda-curved surface and all the combustion air is introduced as the fuel moves from the coanda-curved surface to the surface of the burner tile. Accordingly, as the fuel moves from the coanda-curved surface to the surface of the burner tile at least a near-stoichiometric combustible mixture is produced. "Near-stoichiometric" refers to having a fuel and oxidant ration that is substantially close to that necessary for stoichiometric combustion of the primary fuel. Generally, the embodiments described herein will produce a fuel-air combustible mixture that is near-stoichiometric, typically in the range of from about −5% to about 10% excess oxidant or air, but more typically, from 0% to 5%, or from 1% to 3% excess oxidant or air. When a secondary fuel nozzle is used, it is within the scope of the invention to produce higher ratio of fuel to air (above 10% excess oxidant or air) where the combustible mixture is considered a lean combustible mixture.

However, in some embodiments a minor amount of combustion air or pre-mix air will be mixed into the fuel (including any inert furnace gases) while the fuel is still flowing across the coanda-curved surface. This minor amount of combustion air is less than the amount required to make a stoichiometric mixture, that is, the pre-mix air and fuel mixture will not have a ratio of fuel and oxidant necessary for stoichiometric combustion of the fuel. Rather, the pre-mix air will be introduced so as to produce a rich premix. A "rich" premix indicates a fuel/oxidant mixture containing less oxidant than the amount required to completely combust the fuel. Generally, the embodiments described herein can be in the range of from 0% to 75% of the oxidant or air necessary to completely combust the fuel, but more typically, from 10% to 50%. Accordingly, in embodiments with the pre-mix air, a fuel-rich pre-mix is produced as the fuel travels across the coanda-curved surface and at least a stoichiometric mixture will be produced as the fuel-rich pre-mix moves from the coanda-curved surface to the surface of the burner tile. In some embodiments, a near-stoichiometric combustible mixture will be produced as the fuel-rich pre-mix moves from the coanda-curved surface to the surface of the burner tile. In other embodiments, a lean combustible mixture will be produced as the fuel-rich pre-mix moves from the coanda-curved surface to the surface of the burner tile The above designs can operate on any fuel gas composition including 100% hydrogen, without flashback of the flame into the burner's interior. Moreover, the designs described herein can run at low, medium or high fuel pressure or flame speeds and achieve low $NO_x$ emissions and also avoid flashback problems. For example, the burners described herein can operate from 3 bar(g) fuel gas pressure to a few hundred mbar(g) at the burner inlet. Further, the disclosed burners can be operated with high inert content, such as inert furnace gases. The burner design allows for evenly heating the furnace wall so that the wall starts radiating evenly to process tubes located at a furnace wall opposite the burner(s). Further, the production of at least a stoichiometric combustible mixture which includes inert furnace gases allows the burner to generate relatively low levels of $NO_X$.

The above features of the burner design can be better understood with reference to the drawings. Specifically, in FIGS. 1 and 2, a burner 10 is illustrated, which is one embodiment of the current burner design. Generally, burner 10 comprises a burner tile 20, which is configured so as to have an outer surface 22 exposed to the inside of a furnace 18. Generally, burner tile 20 is mounted in a wall 12 of the furnace so that outer surface 22 extends along an inside surface 14 of furnace wall 12 in a substantially parallel manner, but may include step 24 so that center region 26 is slightly elevated from inside surface 14 of furnace wall 12, while outer region 28 is substantially coplanar with the furnace wall 12.

More typically, burner tile 20 is mounted at least partially through furnace wall 12 so that inner surface 30 defines at least part or all of a passageway 32 through furnace wall 12. Passageway 32 has a proximal end 36, which is adjacent the outside surface of furnace wall 12, and distal end 38, which terminates at the outer surface 22 of burner tile 20 at the inner surface edge 34 where inner surface 30 meets outer surface 22, typically in center region 26. Proximal end 36 is connected in fluid flow communication with a plenum 39 having an air register 40. Thus, combustion air, either forced or natural draft, can be provided through air register 40 into passageway 32. Generally, natural draft is used with burner 10. In order to limit the effects of air and wind currents, a natural-draft air-damper system, such as air register 40 (illustrated in FIGS. 2 and 6) can be used. Other suitable air-damper systems can be used. For example, suitable systems are the natural-draft air-damper systems disclosed in U.S. Pat. Nos. 9,134,024 and 9,423,127 both to Platvoet et al., which are hereby incorporated by reference.

Figure 2:
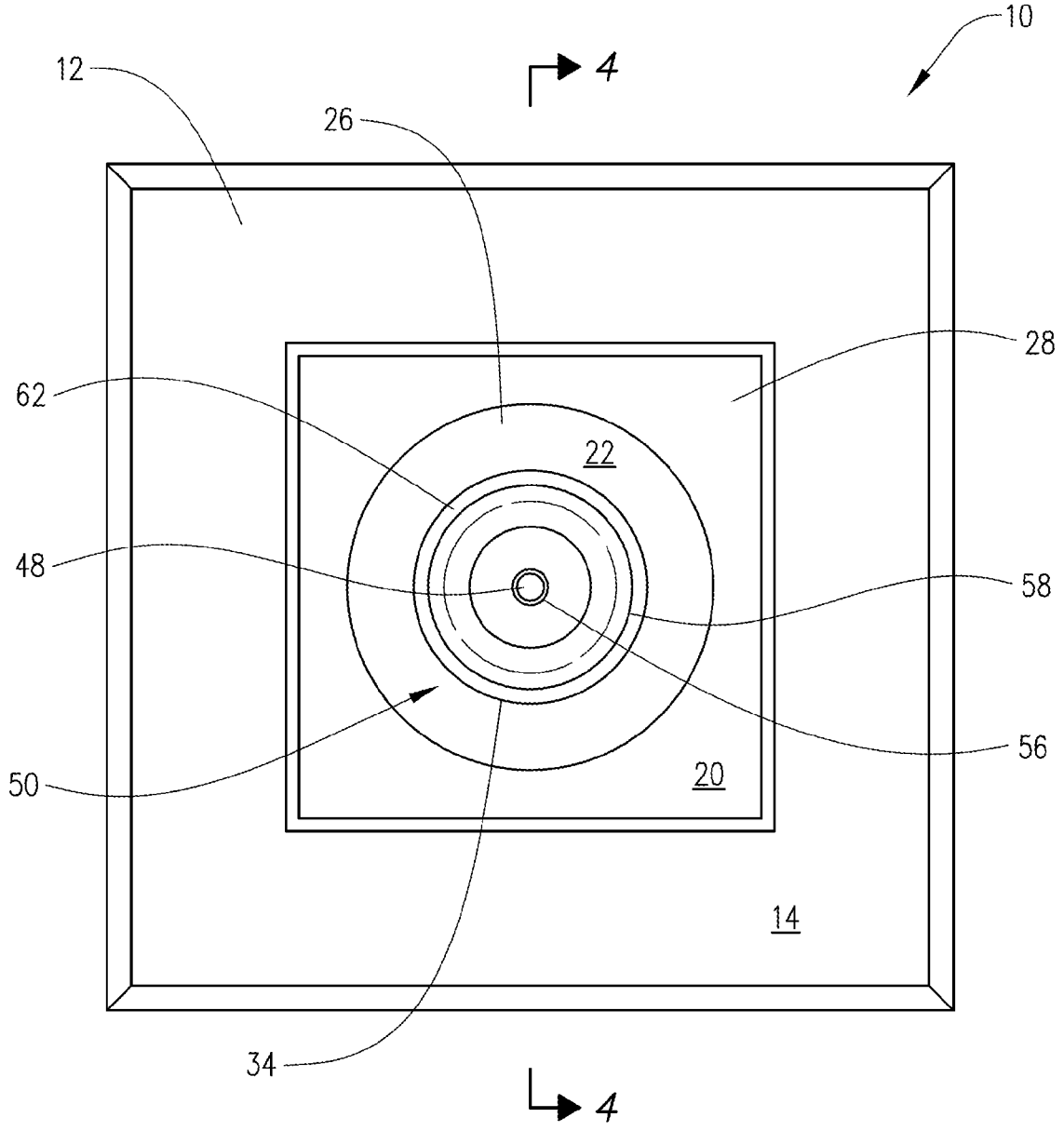
FIG. 2 is a front view of the burner of FIG. 1.
Figure 3:
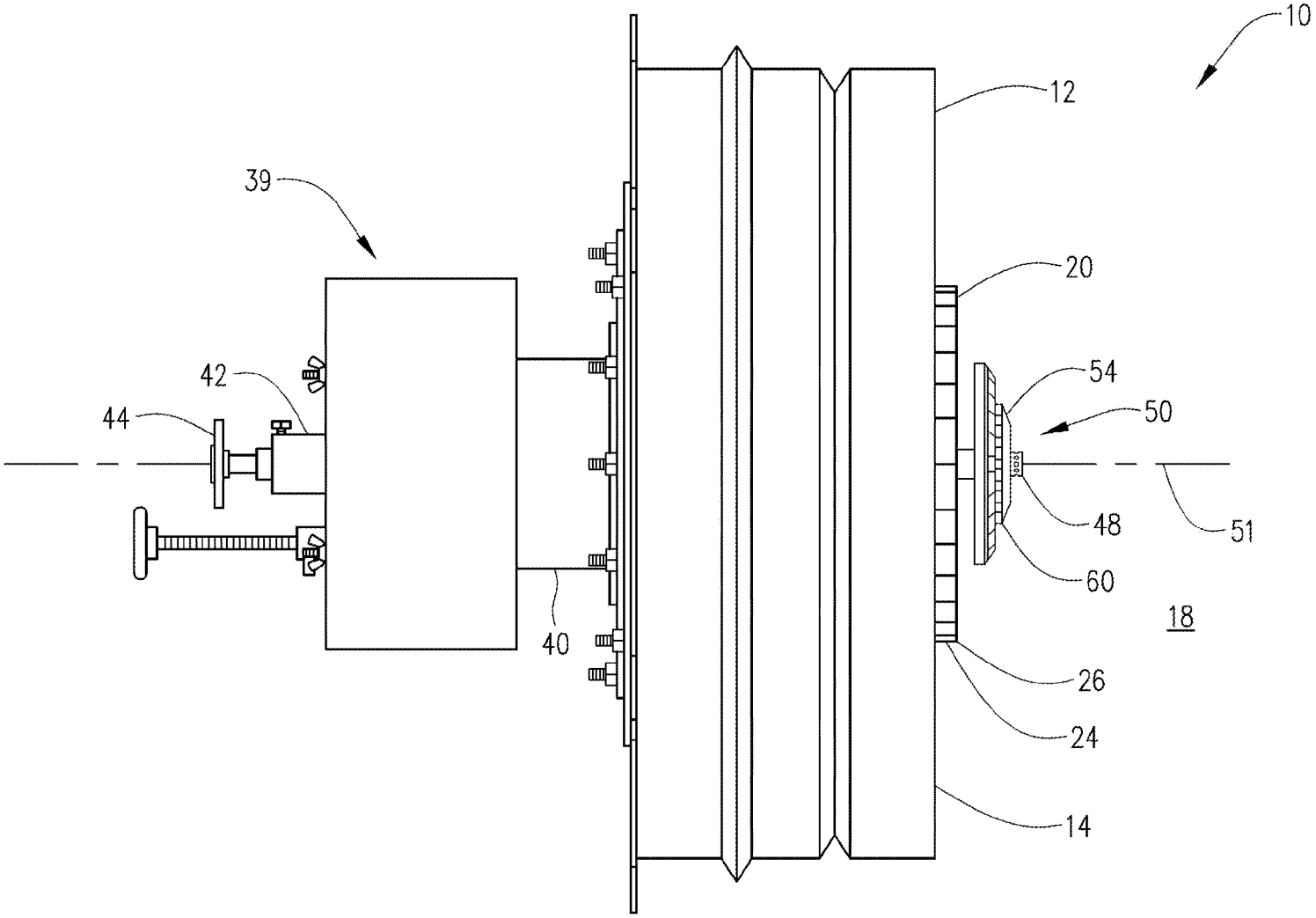
FIG. 3 is a side view of the burner of the embodiment of FIG. 1.
Figure 4:
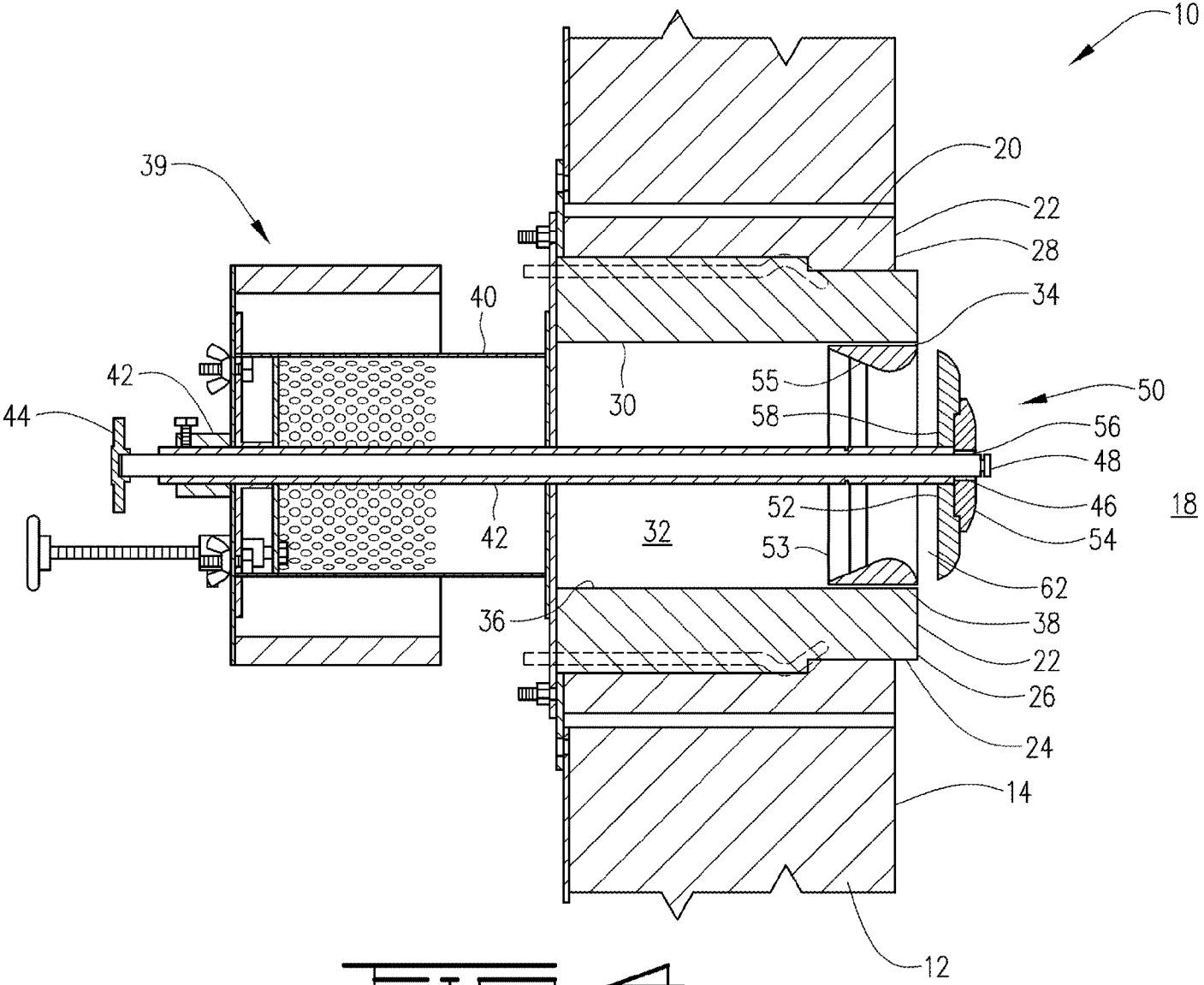
FIG. 4 is a side sectional view of the burner of FIG. 3.
Figure 5:
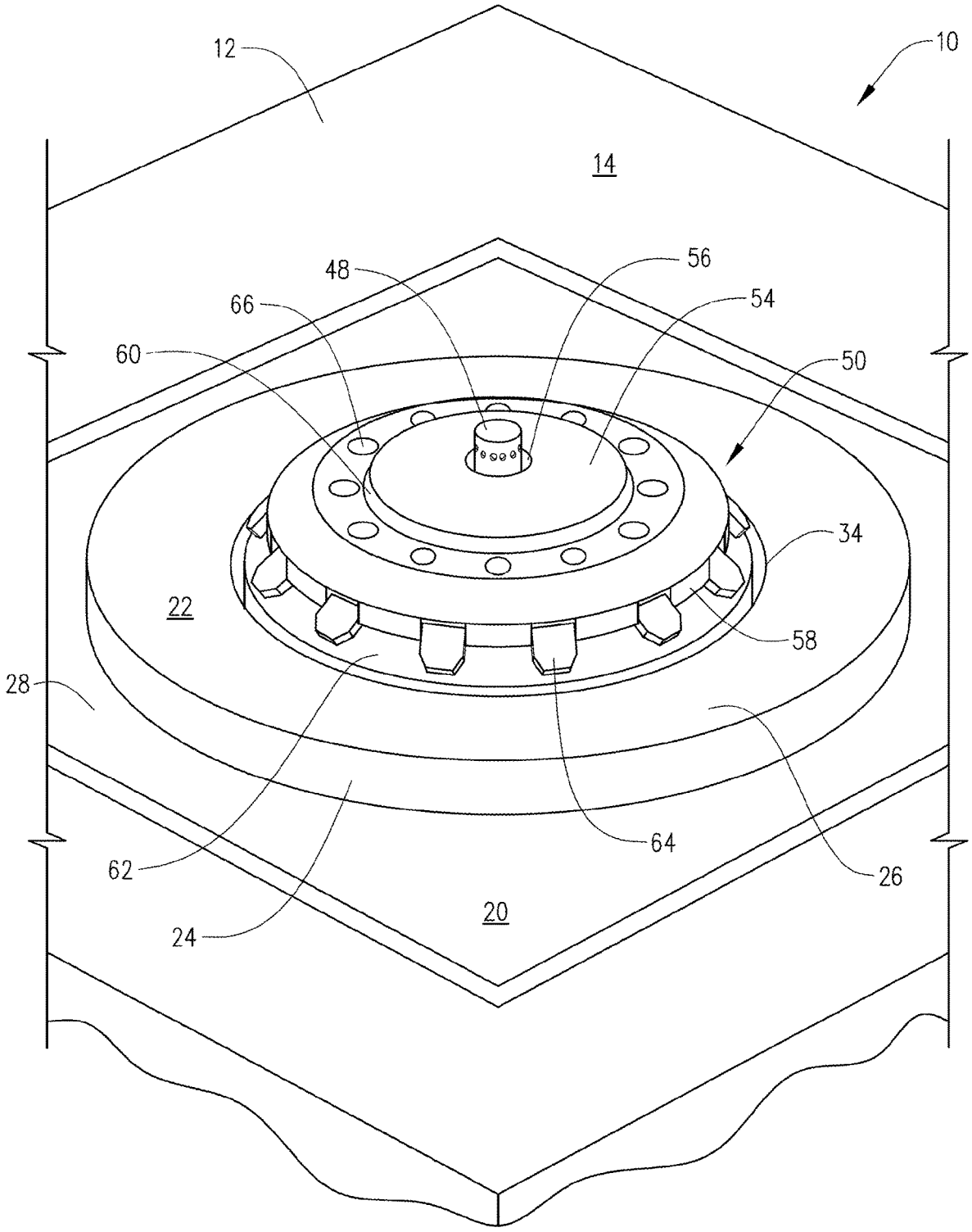
FIG. 5 is a schematic perspective view of a burner in accordance with a second embodiment, which includes stabilizers and pre-mix air ports.
Figure 5:
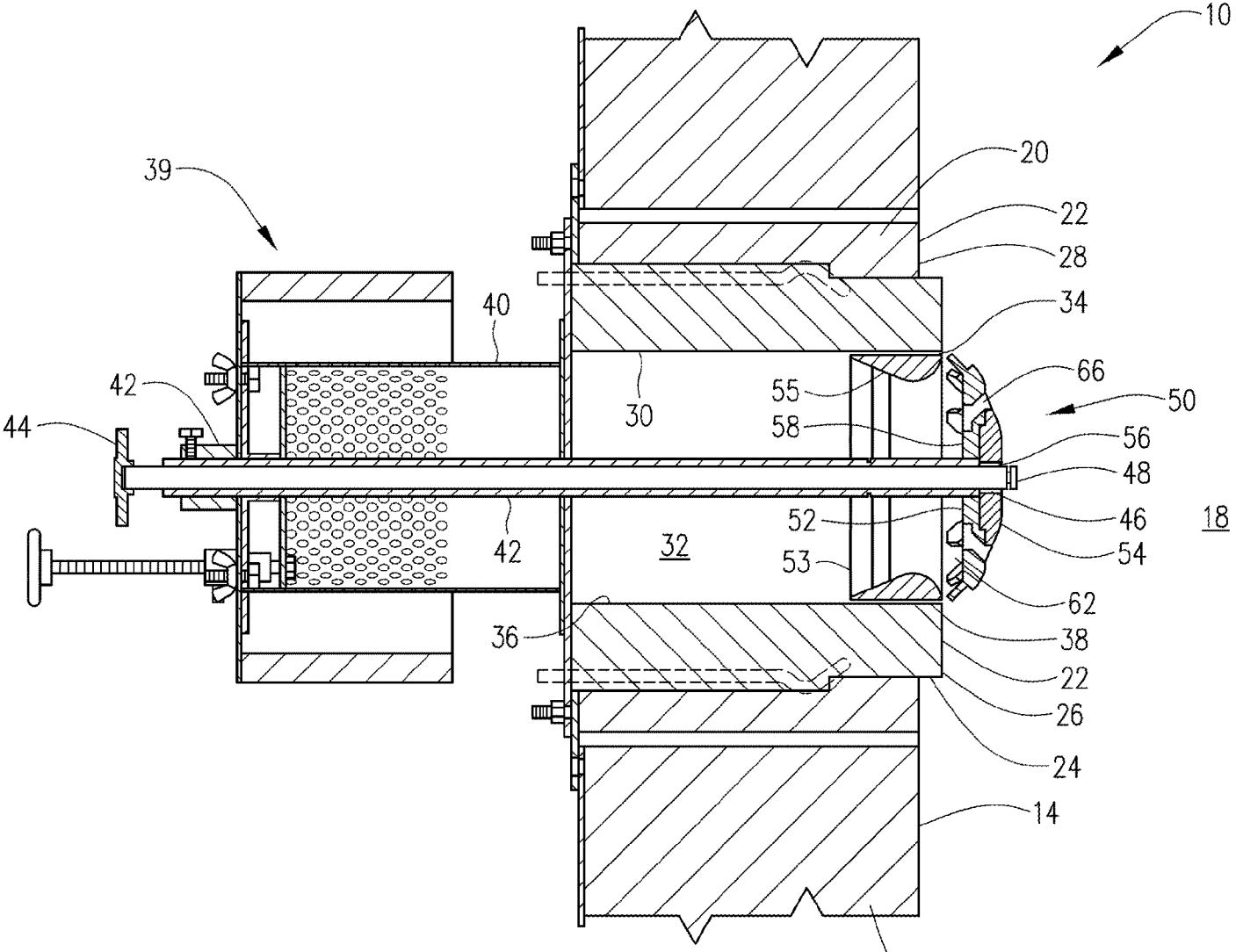

Additionally, a fuel duct 42 extends through passageway 32. A first end 44 of fuel duct 42 is connected to a source of fuel (not shown), typically a gaseous fuel. A second end 46 terminates in a fuel nozzle 48. In the embodiment of FIGS. 1 and 2, fuel duct 42 extends through passageway 32 and through a burner head 50 so as to be farther into the furnace chamber 18 than burner head 50; that is, nozzle 48 is closer to the center of the inside of the furnace than burner head 50. This positioning allows nozzle 48 to direct fuel onto the surface of burner head 50, as further detailed below. FIGS. 1 and 2 illustrate a single fuel duct and fuel nozzle; however, it is within the scope of this disclosure to use multiple fuel ducts and/or multiple fuel nozzles.

As shown, this burner head 50 is located on center region 26 covering distal end 38 of passageway 32. Burner head 50 is formed in the shape of a disk with a flat surface 52 directed to passageway 32 and coanda-curved surface 54 faced to furnace chamber 18. A lower portion 53 of burner head 50 can have a venturi-like air deflector 55. This air deflector 55 reduces the pressure drop of air flowing past and equalizes the airflow. Thus, the air exits the burner parallel to the wall with minimized projection risk. As will be evident from the figures, burner head 50 is removable from passageway 32. Burner head 50 slidingly engages into passageway 32 so as to be removable even during operation of the burner.

For the embodiment of FIGS. 1 and 2 and for that of FIGS. 3-6 (as further discussed below), coanda-curved surface 54 diverges from centerline 51 of the burner to outside the inner surface edge 34 of burner tile 20. In other words, coanda-curved surface 54 is a convex-coanda surface extending farthest out from the plane of furnace wall 12 at a center edge 56, which is adjacent to fuel duct 42 (approximately centerline 51 of the burner). The outside edge 58 of coanda-curved surface 54 is thus the portion of coanda-curved surface 54 closest to the plane of furnace wall 12. In this manner, burner head 50 caps passageway 32 with the coanda-curved surface 54 being a dome-like surface over the distal end 38 of passageway 32. Coanda-curved surface 54 can be smooth all the way from center edge 56 to outside edge 58 or have at least one step 60 located on the surface at any place in between center edge 56 and outside edge 58.

Outside edge 58 of coanda-curved surface 54 and inner surface edge 34 of burner tile 20 define an air channel 62 extending around the burner head. Air channel 62 is in fluid flow communication with passageway 32 such that air flows from passageway 32 through air channel 62 into furnace chamber 18 so as to mix with fuel flowing across coanda-curved surface 54, as further described below.

As illustrated in the embodiment illustrated in FIGS. 3-6, burner head 50 can include stabilizers 64 on outside edge 58 of coanda-curved surface 54. Stabilizers 64 extend out into air channel 62 towards inner surface edge 34 of burner tile 20. Typically, stabilizers 64 will not reach inner surface edge 34 but will leave a small gap, which is about a quarter or less of the width of air channel 62. However, it is within the scope of the invention for stabilizers 64 to reach inner surface edge 34. Stabilizers 64 can be square, rectangular, oval or other suitable shapes and can include holes of suitable size and amount for the particular application. Stabilizers 64 act to turbulize the airflow through air channel 62 so as to better mix air with fuel flowing across coanda-curved surface 54.

As also illustrated in the embodiment of FIGS. 3-6, burner head 50 can include a row of air ports 66, which extend through burner head 50 so as to be in fluid flow communication with passageway 32. Air ports 66 are positioned between center edge 56 and outside edge 58, typically about midway. If coanda-curved surface 54 includes a step 60, air ports 66 can be located to be downstream of and adjacent to step 60 relative to the fuel flow across coanda-curved surface 54. Burner head 50 can have one row, multiple rows or no rows of air ports 66 positioned circumferentially depending on the particulars of fuel composition and application specifics. The number of air ports 66 in a row, diameter or shape, angle of drilling through burner head 50, positioning in respect to step 60 or center of burner head 50 may vary depending on fuel compositions and burner demands Although the embodiment of FIGS. 3-6 is shown with both stabilizers 64 and air ports 66, those skilled in the art will realize that stabilizers 64 can be used on burner head 50 without air ports 66 and, likewise, air ports 66 can be used without stabilizers 64.

As will be realized from the above for the embodiments of FIGS. 1-6, fuel duct 42 is positioned through the center of burner head 50 so that nozzle 48 is at a distance from coanda-curved surface 54. Nozzle 48 can have multiple ports for fuel discharge in radial direction out from burner head centerline 51 and onto coanda-curved surface 54. While the distance of fuel ports from coanda-curved surface 54 and angle to the burner head centerline 51 may vary, they should be chosen to allow the discharged fuel to adhere to coanda-curved surface 54 and spread along that surface all the way through to outside edge 58 of coanda-curved surface 54. The shown burner head 50 has a full 360° of discharge of air and fuel; however, some embodiments can use fewer degrees of discharge of both fuel and/or air. Typically, 100% of the fuel will be discharged on top of the coanda-curved surface 54 through nozzle 48; however, for certain embodiments, less than 100% of the fuel is discharged there and the remainder of the fuel can be injected below burner head 50 such as by injectors located at air channel 62 or air ports 66. As illustrated in the embodiments of FIGS. 1-6, fuel is introduced using a single fuel duct 42 with single fuel nozzle 48; however, it is within the scope of the invention to use multiple fuel ducts and/or multiple fuel nozzles. For example, there may be two or more fuel ducts extending through passageway 32 with each terminating in one or more fuel nozzles. Typically, each of these fuel nozzles will introduce fuel onto coanda-curved surface 54 of burner head 50. Alternatively, there may be only one fuel duct, which terminates in two or more fuel nozzles with each nozzle introducing fuel onto coanda-curved surface 54.

The method of operation of burner 10 has unique features related to combustion air and fuel being delivered, mixed, stabilized and burned on outer surface 22 of burner tile 20 and on inside surface 14 of furnace wall 12 just downstream of burner head 50. This design and method eliminates the possibility of unstable burner operation (flashback) even at 100% hydrogen fuel. In operation, combustion air is delivered through air register 40 of the plenum 39 into passageway 32, typically a cylindrical passageway. The air flow is deflected by the inner surface of burner head 50 (flat surface 52 in FIGS. 2 and 6) to travel out through air channel 62 and along outer surface 22 of burner tile 20 and further along inside surface 14 of furnace wall 12. The fuel is injected radially from nozzle 48 onto the center of coanda-curved surface 54. The fuel spreads along and across coanda-curved surface 54 to flow generally from the center edge 56 to outside edge 58. Thus, the fuel flows across coanda-curved surface 54 and then along outer surface 22 of burner tile 20 and further along inside surface 14 of furnace wall 12.

The fuel mixes with inert gases from the furnace chamber as it flows across the coanda-curved surface. High momentum fuel jets while traveling along coanda-curved surface 54 are exposed to furnace atmosphere, which consists mostly of inert gases like $CO_2$, $H_2O$, and $N_2$. This results in intensive mixing of the inert gases with the flowing fuel jets before the fuel meets and mixes with the main air stream from air channel 62. The inert gases added to the flame reduce thermal $NO_X$ formation significantly, and thus burner 10 operates as low $NO_X$ emission burner.

As mentioned, the fuel mixes with air from air channel 62 as the fuel flows across air channel 62 and onto burner tile 20 to produce a combustible mixture. If used, stabilizers 64 on the outer circumference of burner head 50 (FIGS. 3-6) generate a turbulent zone, in which the fuel is trapped and flame is stabilized. This feature increases start up stability and lowers CO emissions at furnace 'cold' start conditions. Turbulizing the air stream also leads to shortening the flame diameter, which is important for effective positioning of multiple burners on the furnace wall. If the burner tile includes step 24, this step helps to increase the mixing between the fuel and combustion air and thus to shorten the flame diameter as well.

If air ports 66 are used as shown in FIGS. 3-6, the fuel can partially premix with first stage air coming from air ports 66 holes as the fuel flows across air ports 66. The mixing with air from air ports 66 produces a fuel-rich pre-mix. Afterwards, the fuel meets and further mixes with the main air stream coming out of air channel 62 formed by burner head 50 and burner tile 20 to produce the combustible mixture. Air ports 66 on coanda-curved surface 54 allow for some premix of fuel and air, increasing the burner stability during 'cold' furnace start-up, especially on natural gas, and limit the CO emissions during such cold start-up.

The combustible mixture is ignited to produce a flame so that flame anchoring occurs on the burner outside the coanda-curved surface 54 of burner head 50. Generally, the flame anchoring is at the zone starting at the outside edge 58 of coanda-curved surface 54 and extending downstream therefrom onto outer surface 22 of burner tile 20. More typically, the flame anchoring is at outside edge 58 of coanda-curved surface 54. Accordingly, the combustible mixture is burned on outer surface 22 of burner tile 20 and continues to spread and burn on inside surface 14 of furnace wall 12. As a result, the flame has a shape of a disk—flat flame on outer surface 22 of burner tile 20 and inside surface 14 of furnace wall 12. The flame heats the refractory surface of the burner tile and furnace wall, which radiate uniformly, delivering the heat flux to the process tubes across the furnace from burner 10.

Figure 7:
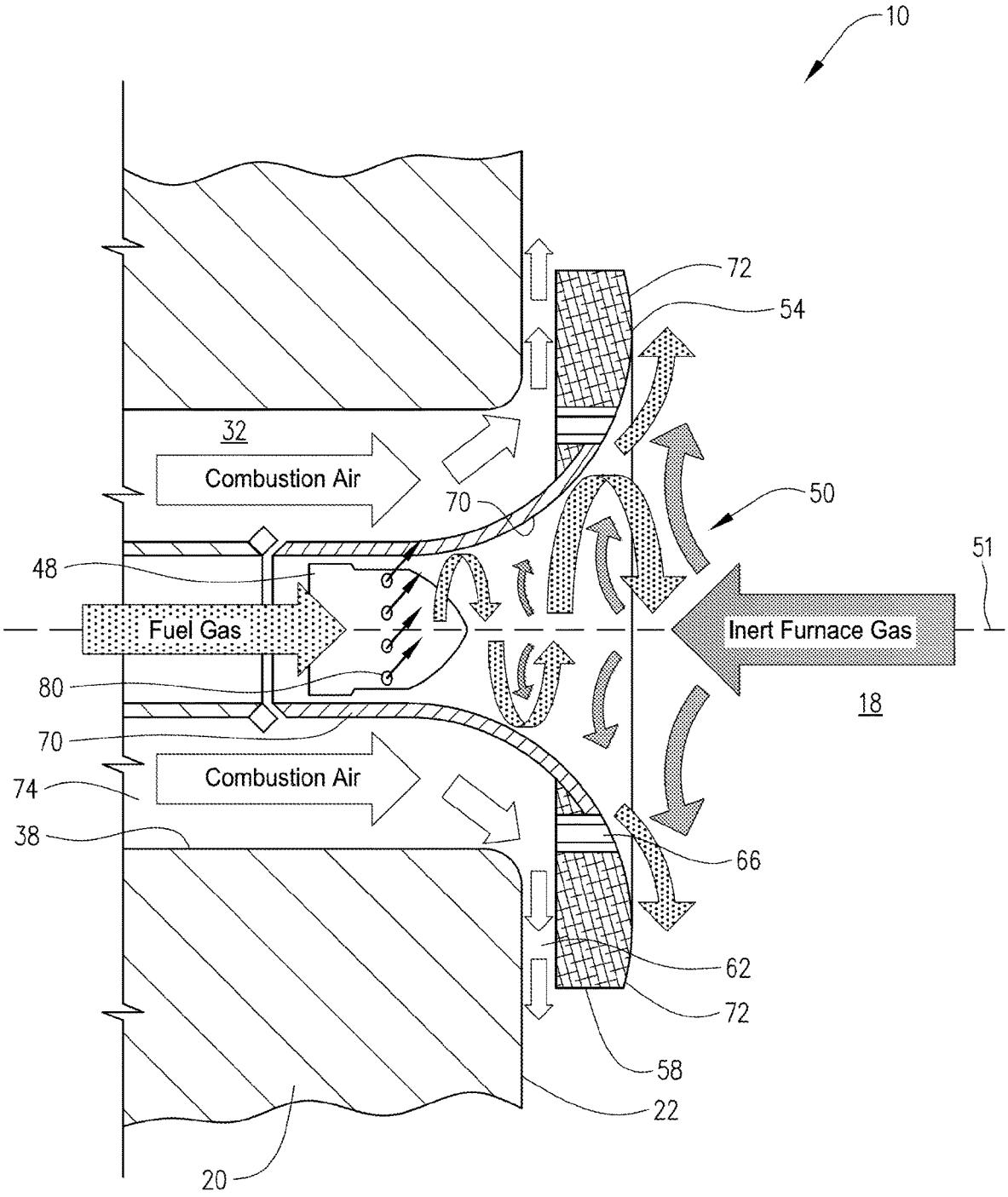
FIG. 7 is a sectional side view of a burner in accordance with a second embodiment.

Turning now to FIG. 7, another embodiment of a burner 10 is illustrated. In FIG. 7, a first portion 70 of coanda-curved surface 54 is depressed into a part of passageway 32. At that part of passageway 32, the first portion 70 and passageway 32 define an annular portion 74 of passageway 32 through which air is provided to air channel 62 and, if used, air ports 66. As will be noted, first portion 70 is configured as a divergent conical surface with its narrowest portion being recessed in passageway 32 and its widest portion being adjacent to distal end 38 of passageway 32. Accordingly, the first portion 70 is depressed into a part of the air passageway 32 so as to define annular portion 74 of the air passageway 32, and the first portion is configured to form an inner divergent conical surface, as shown in FIG. 7. In other words, the inner surface of the first portion 70 defines a divergent conical surface which generally faces the centerline 51 and diverges so that at least part of the divergent conical surface faces the interior of the furnace.

A optional second portion 72 of coanda-curved surface 54 is configured as a convex-coanda surface. As can be seen from FIG. 7, convex-coanda curved surface of second portion 72 curves out from air passageway 32 and curves toward burner tile 20 such that the convex curve is facing or towards the interior of the furnace chamber 18. Second portion 72 extends from the first portion 70 to and over the outer surface 22 of burner tile 20. Fuel nozzle 48 is positioned within first portion 70 and is configured to direct the fuel tangentially so as to move cyclonically along first portion 70 and spread radially outward on second portion 72 then onto outer surface 22 of burner tile 20 (as illustrated by the arrows in FIG. 7).

For this embodiment, fuel nozzle 48 is placed deep inside first portion 70 of burner head 20 and has tangentially drilled fuel ports 80 to deliver high momentum fuel jets tangentially to the divergent-cylindrical surface of first portion 70. First portion 70 smoothly transforms to the convex coanda-curved surface of second portion 72. As a result, the fuel swirls inside and gradually expands to follow coanda-curved surface 54 of first portion 70 and second portion 72 to the outside edge 58 of the coanda-curved surface 54 to be mixed with combustion air at air channel 62. Swirling of fuel creates a negative pressure zone along the burner centerline 51, which allows inert furnace gas to be pulled into the burner head and be mixed with swirling fuel. This dilutes the fuel with inert gases before mixing with combustion air, resulting in depression of thermal $NO_X$ formation in the flame.

Figure 8:
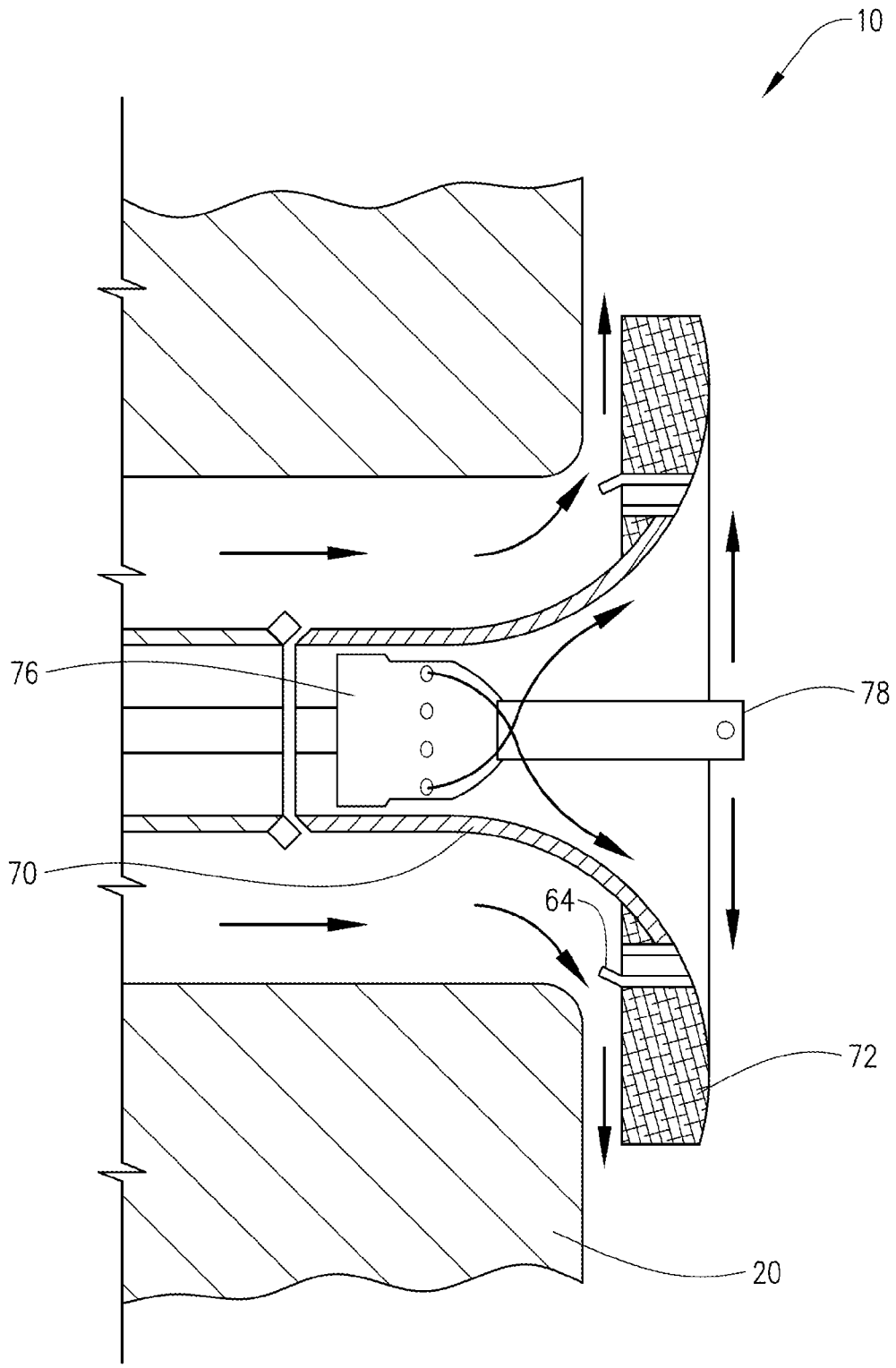
FIG. 8 is a sectional side view of a burner in accordance with a third embodiment.

The embodiment of FIG. 7 is shown without stabilizers; however, stabilizers can be used in a similar manner as stabilizers 64 shown in the embodiment of FIG. 8.

FIG. 8 illustrates an embodiment where radial discharge of fuel can be combined with tangential discharge of fuel by having a first-stage nozzle 76 low in first portion 70 and a second-stage nozzle 78 located further into the furnace chamber than the primary nozzle. Optionally, second-stage nozzle 78 can be at least level with second portion 72 or farther into furnace chamber 18 than second portion 72. Accordingly, first-stage nozzle 76 provides a tangential discharge of fuel and second-stage nozzle 78 provides radial or generally radial discharge of fuel. Accordingly, this embodiment allows for the fuel to be introduced onto the conanda-curved surface in more than one location, such as introducing fuel below and onto the coanda-curved surface.

While methods are described in terms of "comprising," "containing," or "including" various steps, the methods also can "consist essentially of" or "consist of" the various steps. Whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Additionally, where the term "about" is used in relation to a range it generally means plus or minus half the last significant figure of the range value, unless context indicates another definition of "about" applies.

Also, the terms in the claims have their plain, ordinary meaning unless otherwise explicitly and clearly defined by the patentee. Moreover, the indefinite articles "a" or "an", as used in the claims, are defined herein to mean one or more than one of the elements that it introduces. If there is any conflict in the usages of a word or term in this specification and one or more patent(s) or other documents that may be incorporated herein by reference, the definitions that are consistent with this specification should be adopted.

What is claimed is:

1. A burner for burning a combustible mixture in a furnace to produce a flame, wherein the combustible mixture comprises fuel and air, the burner comprising:

a burner tile having an outer surface and an inner surface, the outer surface extends along a furnace wall of the furnace, and the inner surface defines a passageway extending normal to the outer surface, wherein the passageway terminates in a distal end at the outer surface;

a fuel duct extending at least partially through the passageway and terminating in at least one fuel nozzle;

a burner head positioned at the distal end of the passageway and forming a coanda-curved surface, wherein the nozzle directs fuel onto the coanda-curved surface such that the fuel flows along the coanda-curved surface to the outer surface of the burner tile, wherein the fuel nozzle and burner head are configured so that the fuel mixes with inert gases from the furnace during flow along the coanda-curved surface to produce a fuel-inert gas mixture prior to mixing with air from the passageway; and an air channel defined by an outside edge of the coanda-curved surface and in fluid flow communication with the passageway, wherein the air channel is configured such that the air flows from the passageway through the channel to mix with the fuel-inert gas mixture coming from the coanda-curved surface so as to produce the combustible mixture and such that the flame is produced at the outer surface of the burner tile such that flame spreads along the furnace wall surrounding the burner tile.

2. The burner of claim 1, further comprising a plurality of stabilizers extending from the outside edge of the coanda-curved surface into the air channel.

3. The burner of claim 1, wherein the flame is produced such that flame anchoring is outside the coanda-curved surface.

4. The burner of claim 1, wherein all the fuel for the combustible mixture is introduced through the fuel nozzle.

5. The burner of claim 1, wherein the coanda-curved surface further includes a plurality of air ports in fluid flow communication with the passageway, wherein the air ports are positioned where the fuel-inert gas mixture has been produced and such that fuel-inert gas mixture flowing along the coanda-curved surfaces mixes with air from the air ports prior to the fuel-inert gas mixture mixing with air passing through the air channel, and wherein the mixing of fuel-inert gas mixture with air from the air ports produces a fuel rich premix.

6. The burner of claim 1, wherein the burner head caps the distal end of the passageway with the coanda-curved surface being a dome-like surface over the distal end of the passageway, and the fuel duct extends through the burner head so that the fuel nozzle is positioned outside the passageway and within the furnace, and wherein the nozzle is configured to direct fuel radially outward and onto the coanda-curved surface.

7. The burner of claim 6, further comprising a plurality of stabilizers extending from the outside edge of the coanda-curved surface into the air channel, and wherein all the fuel for the combustible mixture is introduced through the fuel nozzle, and the coanda-curved surface further includes a plurality of air ports in fluid flow communication with the passageway, wherein the air ports are positioned where the fuel-inert gas mixture has been produced and such that fuel-inert gas mixture flowing along the coanda-curved surfaces mixes with air from the air port prior to the fuel-inert gas mixture mixing with air passing through the air channel, and wherein the mixing of fuel-inert gas mixture with air from the air ports produces a fuel rich premix, and wherein the fuel rich premix mixes with air passing through the air channel such that the flame is produced with flame anchoring occurring outside the coanda-curved surface.

8. The burner of claim 1, wherein a first portion of the coanda-curved surface is depressed into a part of the passageway so as to define an annular portion of the passageway around the first portion of the coanda surface, and the first portion is configured to form an inner divergent conical surface, and wherein the fuel nozzle is positioned within the first portion and is configured to direct the fuel tangentially so as to move cyclonically along the inner divergent conical surface.

9. The burner of claim 8, wherein a second portion of the coanda-curved surface is configured as a convex-coanda surface curving out from the air passageway and towards the outer surface of the burner tile with the second portion extending from the first portion to the outer surface of the burner tile, and wherein the fuel, after moving cyclonically along the first portion, spreads radially outward on the second portion and onto the outer surface of the burner tile.

10. The burner of claim 9, further comprising a plurality of stabilizers extending from the outside edge of the coanda-curved surface into the air channel, and wherein all the fuel for the combustible mixture is introduced through the fuel nozzle and the coanda-curved surface further includes a plurality of air ports in fluid flow communication with the passageway, wherein the air ports are positioned where the fuel-inert gas mixture has been produced and such that fuel-inert gas mixture flowing along the coanda-curved surfaces mixes with air from the air port prior to the fuel-inert gas mixture mixing with air passing through the air channel, and wherein the mixing of fuel-inert gas mixture with air from the air ports produces a fuel rich premix, and wherein the fuel rich premix mixes with air passing through the air channel such that the flame is produced with flame anchoring occurring outside the coanda-curved surface.

11. The burner of claim 9, wherein a secondary fuel nozzle is positioned further into the furnace chamber than the primary nozzle, and wherein the secondary fuel nozzle is configured to direct fuel generally radially outward.

* * * * *